US012791193B2

(12) United States Patent
Park et al.

(10) Patent No.: US 12,791,193 B2
(45) Date of Patent: Nov. 10, 2026

(54) COOKING APPLIANCE

(71) Applicant: Samsung Electronics Co., Ltd., Suwon-si (KR)

(72) Inventors: Geunyong Park, Suwon-si (KR); Jonghoon Lee, Suwon-si (KR); Pungyeun Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 417 days.

(21) Appl. No.: 18/504,035

(22) Filed: Nov. 7, 2023

(65) Prior Publication Data

US 2024/0077205 A1 Mar. 7, 2024

Related U.S. Application Data

(63) Continuation of application No. PCT/KR2022/007413, filed on May 25, 2022.

(30) Foreign Application Priority Data

Jun. 4, 2021 (KR) ..... 10-2021-0072503
Aug. 11, 2021 (KR) ..... 10-2021-0106042

(51) Int. Cl.
*F24C 3/12* (2006.01)
*F24C 15/00* (2006.01)
*F24C 15/02* (2006.01)

(52) U.S. Cl.
CPC ..... *F24C 3/124* (2013.01); *F24C 15/028* (2013.01); *F24C 15/001* (2013.01)

(58) Field of Classification Search
None
See application file for complete search history.

(56) References Cited

U.S. PATENT DOCUMENTS 1,560,879 A * 11/1925 Tinnerman ..... F24C 15/02 126/190
2,918,916 A * 12/1959 Nelson ..... F24C 15/08 126/21 R (Continued)

FOREIGN PATENT DOCUMENTS

CN 107514659 A * 12/2017 ..... H05B 6/642
EP 0261083 A2 * 3/1988 ..... A47L 15/4265

(Continued)

OTHER PUBLICATIONS

International Search Report and Written Opinion of the International Searching Authority dated Sep. 14, 2022, in connection with International Application No. PCT/KR2022/007413, 8 pages.

(Continued)

*Primary Examiner* — Jorge A Pereiro

(57) ABSTRACT

The present disclosure relates to a cooking apparatus. The cooking apparatus includes a main body including a cooking chamber, a door mounted on a front of the main body to open and close the cooking chamber, a control panel disposed above the door and on which a knob is mounted, and a heat dissipation guide detachably mounted to a lower portion of the control panel, wherein the heat dissipation guide is provided to protrude from a lower surface of the control panel toward the door to block a heated air discharged through a gap between the control panel and the door from directing to the knob.

17 Claims, 8 Drawing Sheets

(56) References Cited

U.S. PATENT DOCUMENTS

| | | | | |
|---|---|---|---|---|
| 2,988,315 | A * | 6/1961 | Saxe | A47G 25/06 211/106.01 |
| 3,057,341 | A * | 10/1962 | Perl | F24C 15/006 126/21 R |
| 3,782,360 | A * | 1/1974 | Brucken | F24C 15/02 126/273 R |
| 3,930,297 | A | 1/1976 | Potucek et al. | |
| 4,457,201 | A | 7/1984 | Storey | |
| 4,660,050 | A | 4/1987 | Phillips | |
| 5,383,328 | A | 1/1995 | Brown | |
| 5,611,610 | A * | 3/1997 | Katz | D06F 39/12 312/265.5 |
| 5,937,550 | A | 8/1999 | Emrich | |
| 5,943,208 | A | 8/1999 | Kato et al. | |
| 5,971,510 | A * | 10/1999 | Lickiss | D06F 39/12 312/293.1 |
| 6,097,908 | A | 8/2000 | Uchiyama et al. | |
| 6,119,688 | A | 9/2000 | Whaley et al. | |
| 6,747,611 | B1 | 6/2004 | Budd et al. | |
| 7,073,352 | B2 | 7/2006 | Tijerina-Ramos et al. | |
| 7,249,802 | B2 | 7/2007 | Schmitz et al. | |
| 7,621,850 | B2 | 11/2009 | Piaget et al. | |
| 7,867,173 | B2 | 1/2011 | Hibner et al. | |
| 8,373,428 | B2 | 2/2013 | Eldridge et al. | |
| 8,450,656 | B2 * | 5/2013 | Doyal | F24C 15/006 219/443.1 |
| 9,466,749 | B1 | 10/2016 | Au | |
| 9,677,770 | B2 | 6/2017 | Lee et al. | |
| 9,863,667 | B2 | 1/2018 | Au | |
| 10,989,418 | B2 | 4/2021 | Lee et al. | |
| 11,047,579 | B2 | 6/2021 | Lee et al. | |
| 2004/0154909 | A1 * | 8/2004 | Kim | D06F 34/28 200/296 |
| 2017/0086264 | A1 | 3/2017 | Zhou et al. | |
| 2018/0100657 | A1 * | 4/2018 | Yantis | E05B 1/0015 |

FOREIGN PATENT DOCUMENTS

| | | | |
|---|---|---|---|
| EP | 0902132 | A3 | 10/1999 |
| EP | 0752561 | B1 | 12/1999 |
| EP | 0902132 | B1 | 11/2008 |
| EP | 1266230 | B1 | 5/2010 |
| EP | 1930662 | B1 | 12/2016 |
| EP | 3496899 | B1 | 7/2020 |
| JP | H08-152143 | A | 6/1996 |
| JP | H10-253074 | A | 9/1998 |
| JP | 3090068 | B2 | 9/2000 |
| JP | 2010-112638 | A | 5/2010 |
| JP | 6617270 | B2 | 12/2019 |
| KR | 10-0518865 | B1 | 9/2005 |
| KR | 10-2006-0034959 | A | 4/2006 |
| KR | 10-0575163 | B1 | 4/2006 |
| KR | 10-0743713 | B1 | 7/2007 |
| KR | 10-2016-0131814 | A | 11/2016 |
| KR | 10-2018-0028130 | A | 3/2018 |
| KR | 10-2124833 | B1 | 6/2020 |

OTHER PUBLICATIONS

Notice of Grounds for Rejection dated Dec. 19, 2025, in connection with Korean Application No. 10-2021-0106042, 9 pages.

* cited by examiner

COOKING APPLIANCE

CROSS-REFERENCE TO RELATED APPLICATIONS

This application is a Bypass Continuation of International Application No. PCT/KR2022/007413, filed May 25, 2022, which claims priority to Korean Patent Application No. 10-2021-0072503, filed Jun. 4, 2021, and Korean Patent Application No. 10-2021-0106042, filed Aug. 11, 2021, the disclosures of which are herein incorporated by reference in their entirety.

BACKGROUND

1. Field

The present disclosure relates to a cooking apparatus, and more particularly, to a cooking apparatus having an improved knob heat dissipation structure.

2. Description of Related Art

In general, cooking methods of cooking apparatuses, which are apparatuses to heat and cook food, are largely classified into a method of cooking by generating heat for heating food using electricity and a method of cooking by generating heat for heating food using gas.

A cooking apparatus equipped with a gas burner device may cook food using gas as fuel. The gas burner device burns gas to spray flames for heating a cooking container containing food. In addition, an oven may be provided below the gas burner device.

A knob for adjusting a degree of injection of flame generated from the gas burner device may be mounted on the front of the cooking apparatus. The knob may be disposed on an upper side of the cooking apparatus for user convenience.

However, in this case, the knob is heated by heat emitted from the oven below the gas burner device, which may cause inconvenience to a user.

SUMMARY

The present disclosure is directed to providing a cooking apparatus provided with a heat dissipation structure of a knob.

The present disclosure is directed to providing a cooking apparatus having a fastening structure capable of fixing a component to an object without a separate fastener.

An aspect of the present disclosure provides a cooking apparatus including a main body including a cooking chamber, a door mounted on a front of the main body to open and close the cooking chamber, a control panel disposed above the door and on which a knob is mounted, and a heat dissipation guide detachably mounted to a lower portion of the control panel, wherein the heat dissipation guide is provided to protrude from a lower surface of the control panel toward the door to block a heated air discharged through a gap between the control panel and the door from directing to the knob.

The heat dissipation guide may include a first hook provided on one side thereof to be inserted into an inner side of the control panel, and a second hook provided on the other side opposite to the first hook.

The control panel may include a first cutout into which the first hook is inserted, and a second cutout into which the second hook is inserted.

The control panel may include a front body forming a front surface on which the knob is mounted, and a lower body bent rearward from a lower portion of the front body and on which the first cutout and the second cutout are formed.

The control panel may include a panel stopper extending from the lower body into a cutout hole of the second cutout.

The heat dissipation guide may further include a heat dissipation stopper formed to protrude upward from an upper surface thereof so that one side of the heat dissipation stopper is in contact with the panel stopper.

The panel stopper may be provided to be elastically deformable by the heat dissipation stopper.

The heat dissipation stopper may include a pressing surface provided on an upper surface thereof and configured to press the panel stopper toward the inner side of the control panel while the heat dissipation guide is mounted on the control panel, and a support surface provided on a side surface thereof such that the heat dissipation guide comes into contact with the panel stopper and is supported, in a state of being mounted on the control panel.

The second hook may be provided in plurality, and the heat dissipation stopper may be formed between the plurality of second hooks.

The heat dissipation guide may be prevented from movement with respect to the control panel by the panel stopper of the control panel.

The first hook and the second hook may extend from an upper surface of the heat dissipation guide toward the inner side of the control panel in a direction opposite to a side where the panel stopper is provided.

The control panel may include a steel material, and the heat dissipation guide may include a resin material.

The heat dissipation guide may include a coupling body configured to couple to the control panel, and a blocking body extending downward from the coupling body.

The blocking body may include a guide surface provided to face the main body, the guide surface to guide a flow direction of the heated air flowing forward from the main body downward, and a connection surface formed in front of the guide surface to connect the guide surface and the coupling body.

The heat dissipation guide may be hooked to the control panel at a position corresponding to a lower portion of the knob.

Another aspect of the present disclosure provides a cooking apparatus including a main body including a cooking chamber, a door provided to open and close the cooking chamber from the front of the main body, a control panel disposed above the door and including a cutout hole, a heat dissipation guide protruding downward of the control panel to be hooked by being inserted into the cutout hole of the control panel, a heat dissipation stopper extending upward from an upper surface of the heat dissipation guide to be inserted into the control panel, and a panel stopper extending from a lower surface of the control panel toward the cutout hole and provided in contact with the heat dissipation stopper to support one side of the heat dissipation stopper.

The heat dissipation guide may include a guide surface provided to face the main body to guide a flow direction of a heated air discharged through a gap between the control panel and the door downward.

The control panel may include a steel material, and the heat dissipation guide may include a resin material.

Another aspect of the present disclosure provides a cooking apparatus including a main body including a cooking chamber, a door mounted on the front of the main body to open and close the cooking chamber, a knob provided to be operable from the outside, a control panel disposed above the door such that the knob is mount thereon and including a cutout portion on a lower surface thereof, and a heat dissipation guide including a hook extending from an upper surface thereof to be caught on the control panel when inserted into an inner side of the control panel through the cutout portion, and a heat dissipation stopper protruding from the upper surface such that one side thereof is pressed by the control panel.

The control panel may include a panel stopper provided inside the cutout portion to extend toward the heat dissipation stopper so as to be in contact with the heat dissipation stopper.

By providing a heat dissipation guide to prevent a heated air generated inside a main body from directly flowing toward a knob, the knob can be prevented from becoming hotter than a certain temperature.

By fixing the heat dissipation guide to a control panel without a separate fastener, the aesthetics can be improved and the productivity of the product can be increased.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
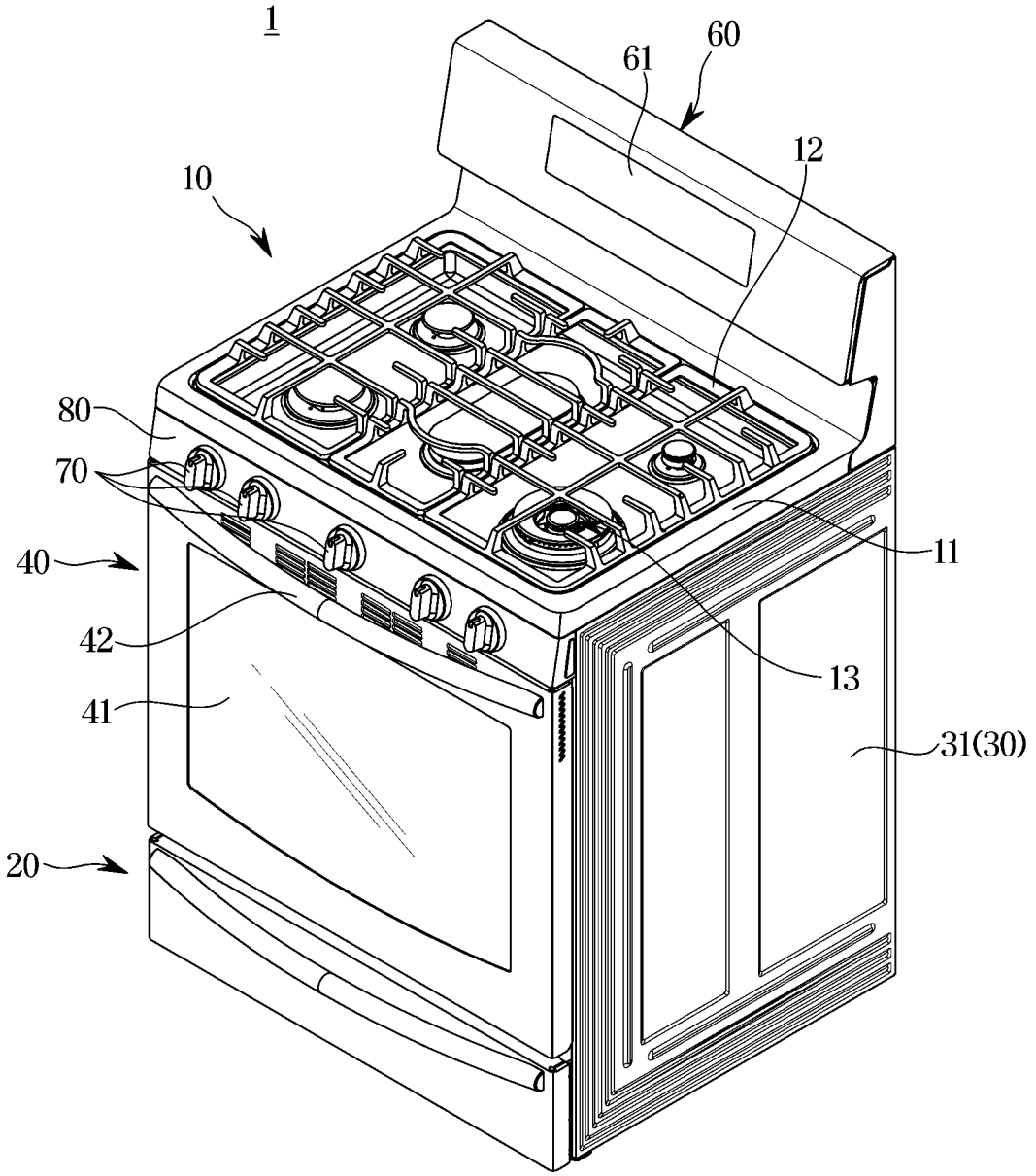
FIG. 1 is a perspective view of a cooking apparatus according to an embodiment of the present disclosure.

FIGS. 1 through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, components, parts, or combinations thereof described in the specification, and do not exclude the presence or addition of one or more other features, numbers, steps, operations, components, parts, or combinations thereof.

It will be understood that, although the terms first, second, etc. may be used herein to describe various components, these components should not be limited by these terms, and the terms are only used to distinguish one component from another. For example, without departing from the scope of the present disclosure, a first component may be referred to as a second component, and similarly, the second component may also be referred to as a first component. The term "and/or" includes any combination of a plurality of related items or any one of a plurality of related items.

Hereinafter, embodiments of the present disclosure will be described in detail with reference to the accompanying drawings.

FIG. 1 is a perspective view of a cooking apparatus according to an embodiment of the present disclosure.

Referring to FIG. 1, a cooking apparatus 1 according to an embodiment of the present disclosure may include an oven 20 and a cooktop 10.

The cooktop 10 may be positioned at an upper portion of the cooking apparatus 1, and the oven 20 may be positioned at a lower portion of the cooking apparatus 1. A cooking chamber may be formed inside the oven 20. Food may be accommodated in the cooking chamber and cooking of the food may be performed.

FIG. 1 illustrates that the cooking apparatus 1 includes the cooktop 10 and the oven 20, but the cooking apparatus 1 according to an embodiment of the present disclosure is not limited thereto.

The cooking apparatus 1 may be provided as a built-in or non-built-in type.

The cooking apparatus 1 may include a main body 30 and a door 40 mounted on the front of the main body 30 to open and close an open front of the main body 30. Therefore, the main body 30 may be provided to include some components of the cooktop 10 and the oven 20. The cooking chamber may be formed inside the main body 30.

The main body 30 may include an outer housing 31 forming an exterior and an inner housing disposed inside the outer housing 31. An insulator may be disposed between the outer housing 31 and the inner housing to prevent heat generated from the cooking chamber from being transferred to the outside.

The inner housing may be provided as an assembly including a front plate 321, a top plate, side plates, a rear plate, and a bottom plate. Among these plates, the side plates and the rear plate may be integrally formed.

The cooking chamber may be formed by the top plate, the side plates, the rear plate, and the bottom plate, and the front plate 321 may be disposed in front of the cooking chamber. An opening may be formed on the front plate 321 to communicate with the cooking chamber. More specifically, the front plate 321 may be provided to face the door 40. A detailed relationship between the front plate 321 and the door 40 will be described later.

The cooktop 10 may include a gas burner device 13 provided to heat food. The gas burner device 13 may use gas as an energy source. The gas burner device 13 may generate thermal power by burning gas.

FIG. 1 illustrates that the cooktop 10 includes five of the gas burners 13, but the number of gas burners 13 is not limited thereto.

The cooktop 10 may include a support plate 11. The support plate 11 may form an upper surface of the cooking apparatus 1. The gas burner device 13 may be mounted on the support plate 11.

A container support member 12 may be disposed above the support plate 11. The container support member 12 may be provided such that a cooking container (not shown) may be placed thereon. The container support member 12 may be provided to be separable from the support plate 11. The container support member 12 may be located above the gas burner device 13.

A plurality of the container support members 12 may be provided depending on the number of gas burners 13.

The oven 20 may be provided below the cooktop 10. A plurality of racks (not shown) may be provided inside the oven 20, and a tray (not shown) may be mounted on each of the racks. Food to be cooked may be accommodated in the tray.

The oven 20 may include the door 40 provided to selectively open or close the front of the cooking chamber.

The door 40 may include a see-through part 41 made of a transparent or translucent material to visually check a cooking state of food accommodated in the cooking chamber. The see-through part 41 may be provided with multiple glass layers. The multiple glass layers may be arranged to be spaced apart from each other with a predetermined gap to allow air for cooling the door 40 to pass therebetween.

The door 40 may also include a handle 42 to be gripped by a user. The handle 42 may be disposed above the see-through part 41 and extend horizontally. The handle 42 may protrude toward the front of the door 40. However, the position of the handle 42 is not limited thereto.

A knob 70 may be provided on an upper side of the front of the cooking apparatus 1. The knob 70 may be provided for setting a function of the cooktop 10 and/or the oven 20.

More specifically, the cooking apparatus 1 may include a control panel 80 provided such that the knob 70 is mounted thereon. The control panel 80 may be disposed above the door 40. The knob 70 may be mounted on a front surface of the control panel 80. A heat dissipation guide 100 (see FIG. 2), which will be described later, may be detachably mounted on a lower portion of the control panel 80. A detailed description related to this will be given later.

As the user manipulates the knob 70, the user may perform on/off setting, temperature setting, time setting, and the like.

FIG. 1 illustrates that five of the knobs 70 are provided, but the number of knobs 70 is not limited thereto and may be changed.

For example, the number of the knobs 70 may be provided to correspond to the number of the gas burners 13. Each of the knobs 70 may be provided to independently control each of the gas burners 13.

The cooking apparatus 1 may include a panel 60. The panel 60 may be formed to protrude upward from the cooktop 10. The panel 60 may include a display 61 provided to display state information of the cooking apparatus 1, such as a temperature of the cooking chamber and a cooking state, to the user. Inside the panel 60, a controller (not shown) may be disposed electrically connected to the display 61 and configured to control the cooking apparatus 1. The display 61 may be disposed adjacent to the knob 70.

Figure 2:
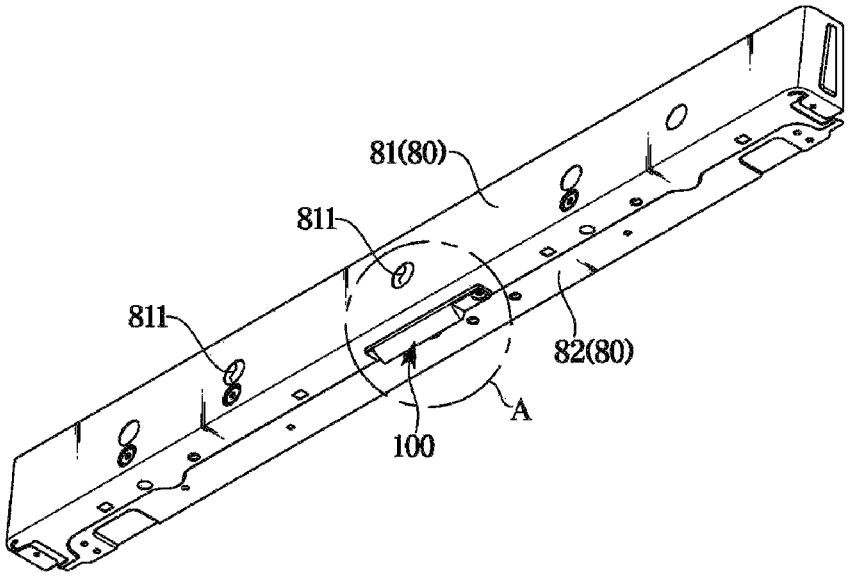
FIG. 2 is a bottom perspective view illustrating a state in which a heat dissipation guide is coupled to a control panel according to an embodiment of the present disclosure.
Figure 3:
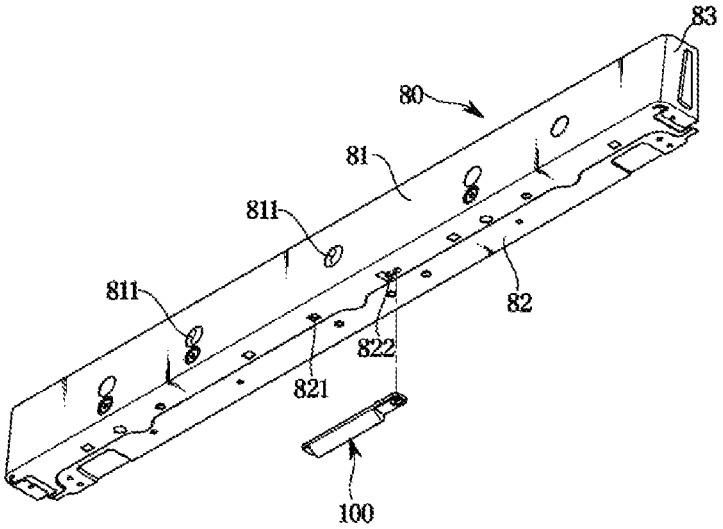
FIG. 3 is an exploded perspective view of the control panel and the heat dissipation guide of FIG. 2.

FIG. 2 is a bottom perspective view illustrating a state in which a heat dissipation guide is coupled to a control panel according to an embodiment of the present disclosure. FIG. 3 is an exploded perspective view of the control panel and the heat dissipation guide of FIG. 2.

FIG. 2 illustrates that the heat dissipation guide 100 is mounted below the central knob 70, but the position of the heat dissipation guide 100 is not limited thereto. A plurality of the heat dissipation guides 100 may be provided below the knobs 70, respectively.

The heat dissipation guide 100 may also extend long over the two knobs 70 to be disposed below the plurality of knobs 70.

Hereinafter, it will be described as an example that the heat dissipation guide 100 is mounted below the knob 70 located in the middle of the five knobs 70.

Referring to FIGS. 2 and 3, the heat dissipation guide 100 may be mounted on the lower portion of the control panel 80. A knob coupling hole 811 to which the knob 70 is mounted may be formed on the front of the control panel 80. More specifically, a front body 81 of the control panel 80 may include the knob coupling hole 811.

The knob coupling holes 811 may be provided to correspond to the number of the knobs 70. Because an embodiment of the present disclosure illustrates and describes that the cooking apparatus 1 includes a total of the five knobs 70, the knob coupling holes 811 may also be provided in five to correspond thereto.

The control panel 80 may include the front body 81 and a lower body 82 bent rearward of the front body 81. The front body 81 may be provided to form a front surface on which the knob 70 is mounted.

The lower body 82 may include a first cutout 821 and a second cutout 822 provided such that portions of the heat dissipation guide 100 are inserted therein. The first cutout 821 and the second cutout 822 may be provided at symmetrical positions with respect to a knob 70 passing hole formed at an upper portion thereof.

The heat dissipation guide 100 may be detachably mounted on the lower body 82 of the control panel 80. The heat dissipation guide 100 may be supported on the control panel 80 by being partially inserted into the first cutout 821 and the second cutout 822 of the control panel 80.

Specifically, the heat dissipation guide 100 may be mounted on the lower portion of the control panel 80 to protrude downward from a lower surface of the control panel 80.

Referring to FIG. 1, the heat dissipation guide 100 may be provided to protrude from the lower surface of the control panel 80 toward the door 40. More specifically, the heat dissipation guide 100 may be provided to protrude from the lower surface of the control panel 80 toward an upper surface of the door 40. The lower surface of the control panel 80 and the upper surface of the door 40 may be provided to be spaced apart from each other by a predetermined interval. A detailed description related to this will be given later.

Figure 4:
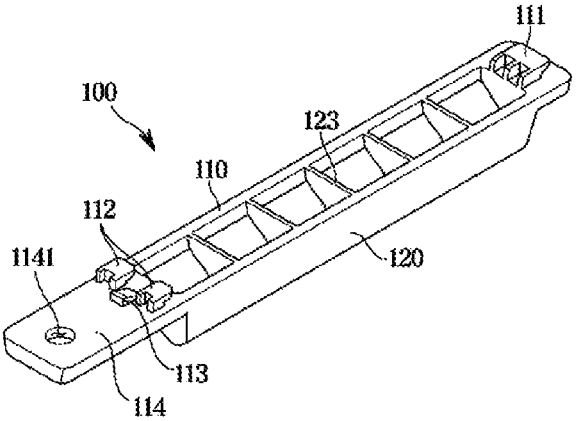
FIG. 4 is a perspective view of the heat dissipation guide of FIG. 3 viewed from an upper rear side.
Figure 5:
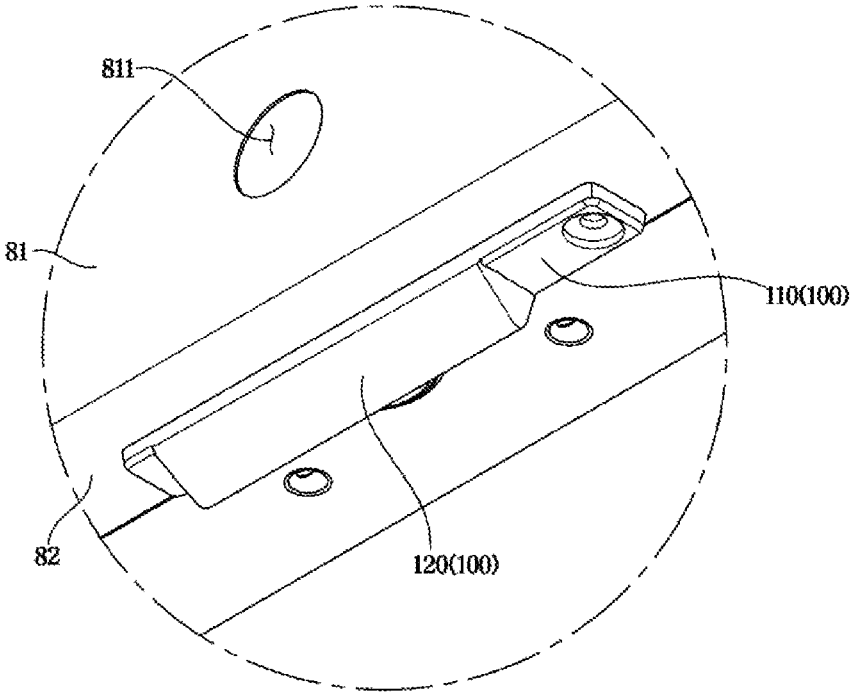
FIG. 5 is an enlarged view of part A of FIG. 2.

FIG. 4 is a perspective view of the heat dissipation guide of FIG. 3 viewed from an upper rear side. FIG. 5 is an enlarged view of part A of FIG. 2.

A detailed configuration of the heat dissipation guide 100 will be described below with reference to FIGS. 4 and 5.

As illustrated in FIGS. 4 and 5, the heat dissipation guide 100 may include a coupling body 110 and a blocking body 120. The heat dissipation guide 100 may be provided to be formed integrally with an injection-molded material. The heat dissipation guide 100 may be provided to include a resin material. However, the material of the heat dissipation guide 100 is not limited thereto.

The coupling body 110 may be provided to be coupled to the control panel 80. The coupling body 110 may be provided such that one surface thereof is in contact with the control panel 80. More specifically, an upper surface of the coupling body 110 and the lower surface of the control panel 80 may be provided to be in contact with each other.

The coupling body 110 may extend horizontally along a left-right direction of the cooking apparatus 1.

The blocking body 120 may be provided to extend downward from the coupling body 110. The blocking body 120 may be integrally formed by being injected with the coupling body 110. The inside of the blocking body 120 may include an empty space. Accordingly, a reinforcing rib 123 may be formed inside the blocking body 120 to reinforce a strength of the blocking body 120. A plurality of the reinforcing ribs 123 may be provided.

The coupling body 110 may include a first hook 111 and a second hook 112.

The first hook 111 may be provided to be inserted into an inner side of the control panel 80. The first hook 111 may be provided on one side of the heat dissipation guide 100.

The first hook 111 may be provided to protrude from the upper surface of the coupling body 110. More specifically, the first hook 111 may extend to be inserted into the inner side of the control panel 80 toward the opposite direction to a side where the heat dissipation stopper 113, which will be described later, is formed.

The second hook 112 may be provided to be inserted into an inner side of the control panel 80. The second hook 112 may be provided on the other side opposite to the first hook 111. The second hook 112 may be provided to protrude from the upper surface of the coupling body 110. The second hook 112 may be provided to extend in the same direction as the first hook 111 so as to be inserted into and supported on the control panel 80.

That is, the first hook 111 and the second hook 112 may be provided to extend from right to left with respect to the front of the cooking apparatus 1 so as to be inserted into the inner side of the control panel 80.

A plurality of the second hooks 112 may be provided. FIG. 4 illustrates that the two second hooks 112 are provided, but the number of second hooks 112 is not limited thereto. Also, the single second hook 112 may be provided like the first hook 111.

The coupling body 110 may include a heat dissipation stopper 113.

The heat dissipation stopper 113 may be formed to protrude upward from an upper surface of the heat dissipation guide 100. More specifically, the heat dissipation stopper 113 may be provided to protrude upward from the upper surface of the coupling body 110.

The heat dissipation stopper 113 may be formed between the plurality of second hooks 112.

The heat dissipation stopper 113 may be provided such that one side thereof is supported by a panel stopper 823 (see FIG. 9), which will be described later. A detailed description related to this will be given later.

The coupling body 110 may include a fastener 114.

The fastener 114 may be provided at an end of the coupling body 110. The blocking body 120 may not be formed below the fastener 114. Therefore, the fastener 114 may be provided as the thinnest part at the end of the heat dissipation guide 100.

The fastener 114 may include a preliminary hole 1141.

The heat dissipation guide 100 may be fixed after being inserted into the inner side of the control panel 80 without a separate fastener. However, depending on circumstances, the heat dissipation guide 100 and the control panel 80 may need to be screwed together. As a preparation for this, a separate fastener may be inserted into and coupled to the preliminary hole 1141 of the fastener 114 and a coupling hole 824 (see FIG. 7) of the control panel 80, which will be described later.

The blocking body 120 may extend downward of the coupling body 110 to have a substantially triangular cross section. The blocking body 120 may be provided to block an airflow when a heated air flowed from the rear of the door 40 flows to a lower side of the control panel 80. A detailed description related to this will be given later.

Figure 6:
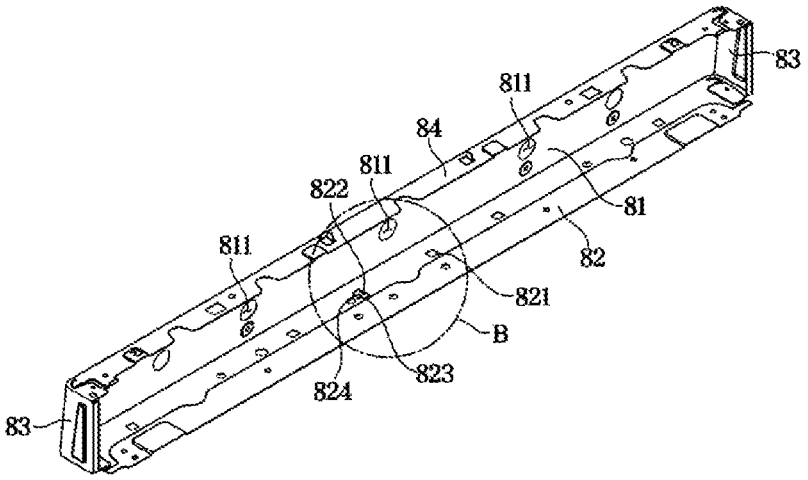
FIG. 6 is a perspective view of the control panel of FIG. 3 viewed from an upper rear side.

FIG. 6 is a perspective view of the control panel of FIG. 3 viewed from an upper rear side.

As illustrated in FIG. 6, the control panel 80 may include the front body 81, the lower body 82, side bodies 83, and an upper body 84.

The front body 81 of the control panel 80 may be provided to form the front surface of the control panel 80. A plurality of the knob coupling holes 811 may be formed on the front body 81 to couple with the knobs 70 (see FIG. 1).

The lower body 82 may be provided to form the lower surface of the control panel 80. The lower body 82 may be formed to be bent rearward of the front body 81. The lower body 82 may be provided such that the heat dissipation guide 100 is mounted thereon. The lower body 82 may be provided to face the upper surface of the door 40.

The first cutout 821, the second cutout 822, the panel stopper 823, and the coupling hole 824 may be provided on the lower body 82. A detailed description related to this will be given later.

The side bodies 83 may be provided to form opposite sides of the control panel 80. The upper body 84 may be provided to form an upper surface of the control panel 80.

The upper body 84 may include a plurality of fastening holes to fix the control panel 80 to the inside of the main body 30. The upper body 84 and the lower body 82 may be provided not to be exposed to the user.

The control panel 80 may be provided to include a steel material. The upper body 84, the side bodies 83, the lower body 82, and the front body 81 of the control panel 80 may be provided as an integrally formed steel panel. However, the material of the control panel 80 is not limited thereto.

Figure 7:
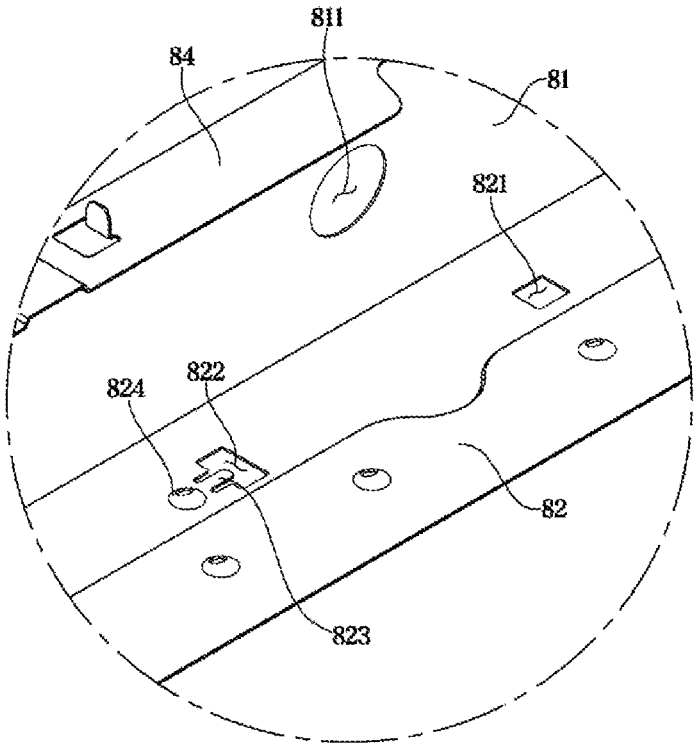
FIG. 7 is an enlarged view of part B of FIG. 6.
Figure 8:
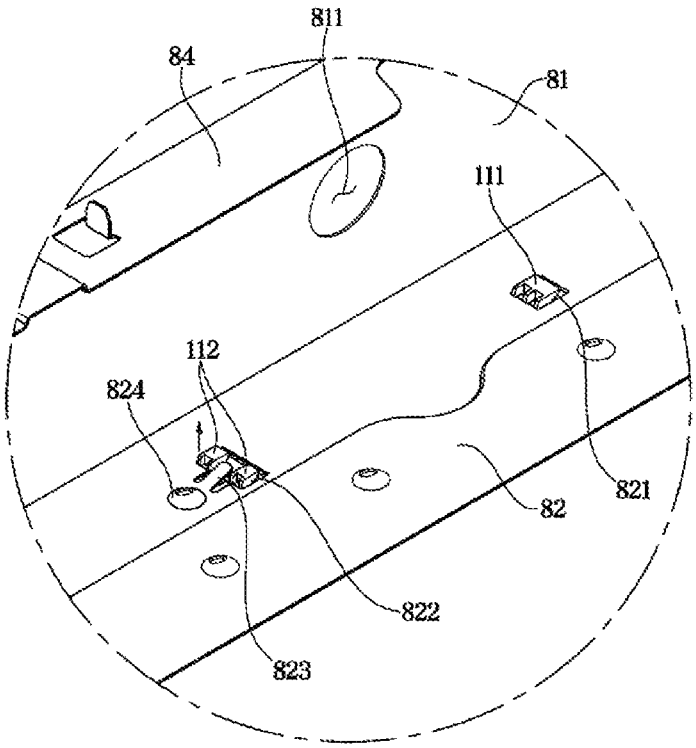
FIG. 8 is a view illustrating a process in which the heat dissipation guide is mounted to the control panel of FIG. 7.
Figure 9:
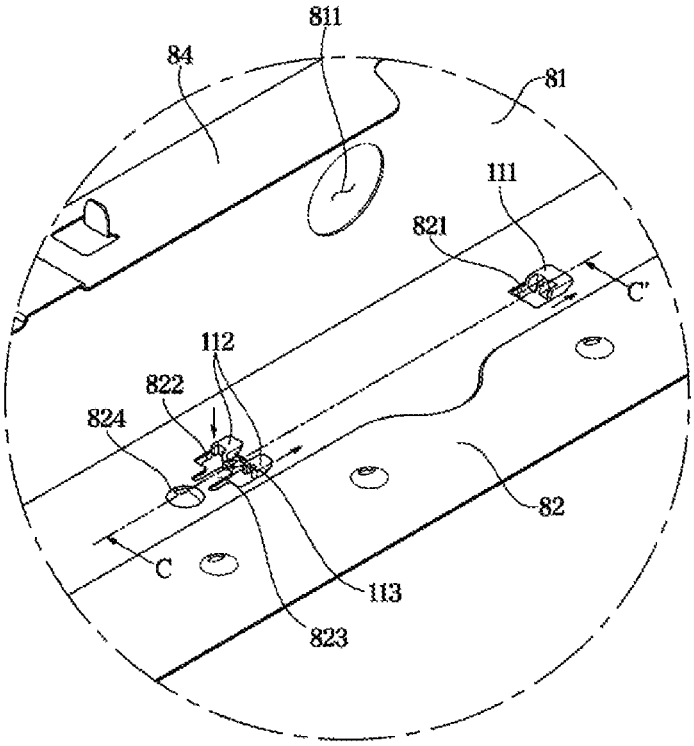
FIG. 9 is a view illustrating a state in which the heat dissipation guide is completely mounted on the control panel of FIG. 7.

FIG. 7 is an enlarged view of part B of FIG. 6. FIG. 8 is a view illustrating a process in which the heat dissipation guide is mounted to the control panel of FIG. 7. FIG. 9 is a view illustrating a state in which the heat dissipation guide is completely mounted on the control panel of FIG. 7.

A process in which the heat dissipation guide 100 is mounted to the control panel 80 will be described below with reference to FIGS. 7 to 9.

As illustrated in FIG. 7, the control panel 80 may include the first cutout 821 and the second cutout 822. The first cutout 821 and the second cutout 822 may be provided to be spaced apart from each other.

The control panel 80 may include the panel stopper 823. Specifically, the panel stopper 823 may be provided to extend toward the inside of a cutout hole formed by the second cutout 822 of the control panel 80. In other words, the panel stopper 823 may extend from the lower body 82 of the control panel 80 toward the inside of the cutout hole formed by the second cutout 822.

The control panel 80 may include the coupling hole 824. The coupling hole 824 of the control panel 80 may be provided to correspond to the preliminary hole 1141 of the heat dissipation guide 100. The separate fastener may more firmly fix the heat dissipation guide 100 to the control panel 80 by passing through the preliminary hole 1141 of the heat dissipation guide 100 and the coupling hole 824 of the control panel 80. However, the separate fastener is not an essential element of the present disclosure.

As illustrated in FIG. 8, the first hook 111 of the heat dissipation guide 100 may be inserted into the first cutout 821 of the control panel 80. At the same time, the second hook 112 of the heat dissipation guide 100 may be inserted into the second cutout 822 of the control panel 80.

At this time, the heat dissipation stopper 113 of the heat dissipation guide 100 may press the panel stopper 823 of the control panel 80 from below. The panel stopper 823 of the control panel 80 may be provided to have a predetermined elasticity to be elastically deformable. Therefore, the panel stopper 823 may be lifted upward by a predetermined height by the heat dissipation stopper 113 in a process of mounting the heat dissipation guide 100.

Thereafter, as illustrated in FIG. 9, the first hook 111 passed through the first cutout 821 may be moved to contact the inner side of the control panel 80. At the same time, the second hook 112 passed through the second cutout 822 may be moved to contact the inner side of the control panel 80. Because the first hook 111 and the second hook 112 extend in the same direction, when the first hook 111 and the second hook 112 are moved to contact the inner side of the control panel 80, the heat dissipation guide 100 may be partially supported vertically by an inner surface of the control panel 80.

In addition, as the heat dissipation guide 100 is moved to one side, the heat dissipation stopper 113 formed on the upper surface of the heat dissipation guide 100 may also be moved in the same direction. Through this, as illustrated in FIG. 8, the heat dissipation stopper 113 that has pressed the panel stopper 823 upward from below may be moved in a lateral direction of the panel stopper 823.

As the heat dissipation stopper 113 is moved in the lateral direction of the panel stopper 823, the panel stopper 823 returns to an original position thereof from a state of being partially elastically deformed upward.

At this time, the heat dissipation stopper 113 is disposed on a side of the panel stopper 823, and by an elastic force of the panel stopper 823, the heat dissipation stopper 113 and the panel stopper 823 may apply a supporting force along a horizontal direction to each other.

Through this, the heat dissipation guide 100 may be prevented from moving its in the inner side of the control panel 80. A more detailed description of the support structure will be given later.

Figure 10:
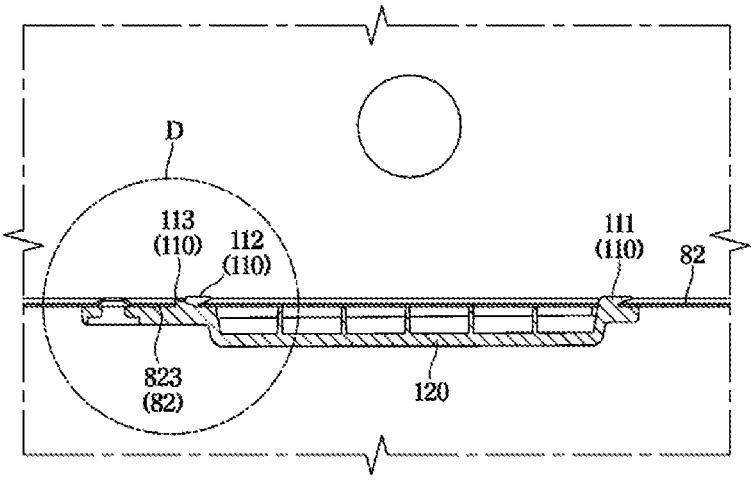
FIG. 10 is a cross-sectional view taken along line C-C' of FIG. 9.

FIG. 10 is a cross-sectional view taken along line C-C' of FIG. 9.

As illustrated in FIG. 10, when the heat dissipation guide 100 is mounted on the control panel 80, the first hook 111 of the heat dissipation guide 100 may be inserted into an inner side of the lower body 82 of the control panel 80. In addition, the second hook 112 of the heat dissipation guide 100 may also be inserted into an inner side of the lower body 82 of the control panel 80.

The heat dissipation stopper 113 formed between the plurality of second hooks 112 may be laterally supported by the panel stopper 823. Specifically, the heat dissipation stopper 113 may be provided to be in contact with a cross section of the panel stopper 823.

Figure 11:
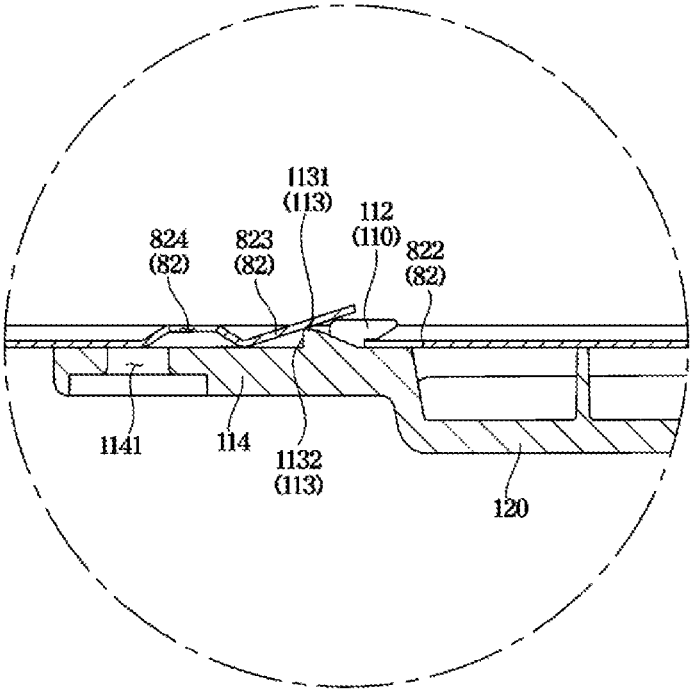
FIG. 11 is an enlarged cross-sectional view of part D of FIG. 10, illustrating the state in which the heat dissipation guide is mounted on the control panel of the cooking apparatus according to an embodiment of the present disclosure, as shown in FIG. 8.
Figure 12:
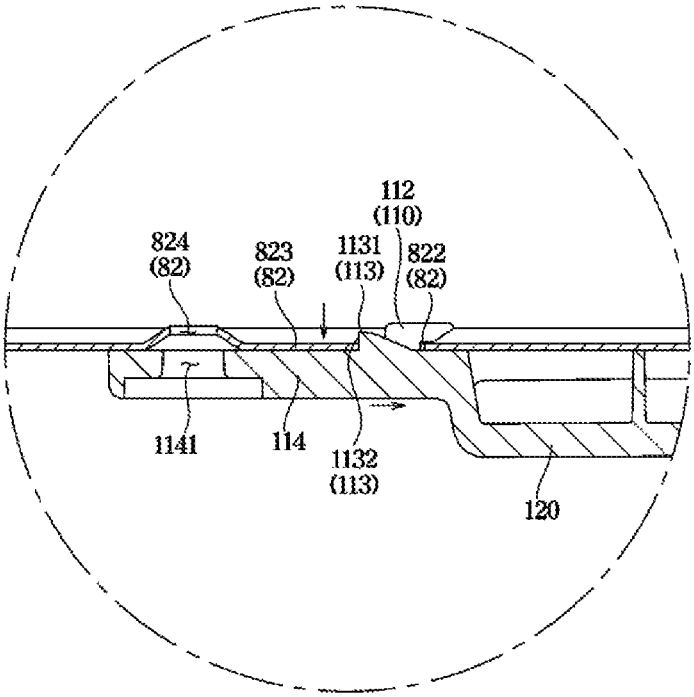
FIG. 12 is a view illustrating the state in which the heat dissipation guide is completely mounted on the control panel of the cooking apparatus according to an embodiment of the present disclosure, as shown in FIG. 9.

FIG. 11 is an enlarged cross-sectional view of part D of FIG. 10, illustrating the state in which the heat dissipation guide is mounted on the control panel of the cooking apparatus according to an embodiment of the present disclosure, as shown in FIG. 8. FIG. 12 is a view illustrating the state in which the heat dissipation guide is completely mounted on the control panel of the cooking apparatus according to an embodiment of the present disclosure, as shown in FIG. 9.

A process in which the heat dissipation guide 100 is inserted into the inner side of the control panel 80 will be described below with reference to the cross-sectional views of FIGS. 11 and 12.

As illustrated in FIGS. 11 and 12, when the second hook 112 of the heat dissipation guide 100 is inserted into the second cutout 822 of the control panel 80, the heat dissipation stopper 113 presses the panel stopper 823 upward. Through this, the panel stopper 823 having the predetermined elasticity is slightly bent upward from the original horizontal position and moved upward.

Thereafter, as the heat dissipation guide 100 is moved to the right with respect to the rear of the cooking apparatus 1, the second hook 112 comes into contact with an inner surface of the lower body 82 of the control panel 80.

At the same time, the panel stopper 823 pressed upward by the heat dissipation stopper 113 returns to the original horizontal position.

The heat dissipation stopper 113 may include a pressing surface 1131 provided to press the panel stopper 823 into the inner side of the control panel 80 while the heat dissipation guide 100 is mounted on the control panel 80. The pressing surface 1131 may be provided on an upper surface of the heat dissipation stopper 113. The pressing surface 1131 may obliquely extend from the upper surface of the heat dissipation guide 100 to have an inclination.

The heat dissipation stopper 113 may include a support surface 1132 provided on a side surface of the heat dissipation stopper to be supported in contact with the panel stopper 823 in a state in which the heat dissipation guide 100 is mounted on the control panel 80. The support surface 1132 may be provided as a surface substantially perpendicular to the upper surface of the heat dissipation guide 100.

When the heat dissipation guide 100 is completely fixed to the control panel 80, the coupling hole 824 of the control panel 80 and the preliminary hole 1141 of the heat dissipation guide 100 may be arranged to communicate with each other. Therefore, a separate fastener may be coupled to the coupling hole 824 and the preliminary hole 1141 as needed.

The heat dissipation guide 100 may be hooked to the control panel 80 at a position corresponding to a lower portion of the knob 70.

Therefore, the heat dissipation guide 100 of the cooking apparatus 1 according to an embodiment of the present disclosure may be fixed to the control panel 80 to prevent movement of the heat dissipation guide 100 in upward, downward, left, and right directions even without a separate fastener.

Through this, as the production process is more simplified, productivity may be improved and product production costs may be reduced. In addition, because a separate fastener is not coupled, deformation of the control panel 80 made of a steel material, which may be occurred while the fastener is tightened, may be prevented.

Because the control panel 80 is a component exposed to the user, the external aesthetics of the overall cooking apparatus 1 may be improved by preventing such deformation.

In addition, as the control panel 80 is made of a steel material, there may be a limit to blocking the heated air discharged toward the knob 70 by pressing the control panel 80 downward to provide a protrusion. Therefore, the heat dissipation guide 100 of the cooking apparatus 1 according to an embodiment of the present disclosure may have a sufficient height for heat dissipation by being detachably coupled to the control panel 80 separately.

As described above, an embodiment of the present disclosure has been described that the heat dissipation guide 100 of the cooking apparatus 1 may be fixed to the control panel 80 through interference between the heat dissipation stopper 113 and the panel stopper 823 without a separate fastener.

However, this assembly structure may not be limited to the heat dissipation guide 100 of the cooking apparatus 1. For example, when a component to be assembled is to be fixed to an object, the above-described assembly structure may be provided to the component to be assembled.

The above-described assembly structure is capable of fixing a component to be assembled to an object without a separate fastener by including the first hook 111 and the second hook 112 at opposite ends thereof and forming respective stoppers that interfere with each other to the component to be assembled and the object, and may be modified as much as possible.

Figure 13:
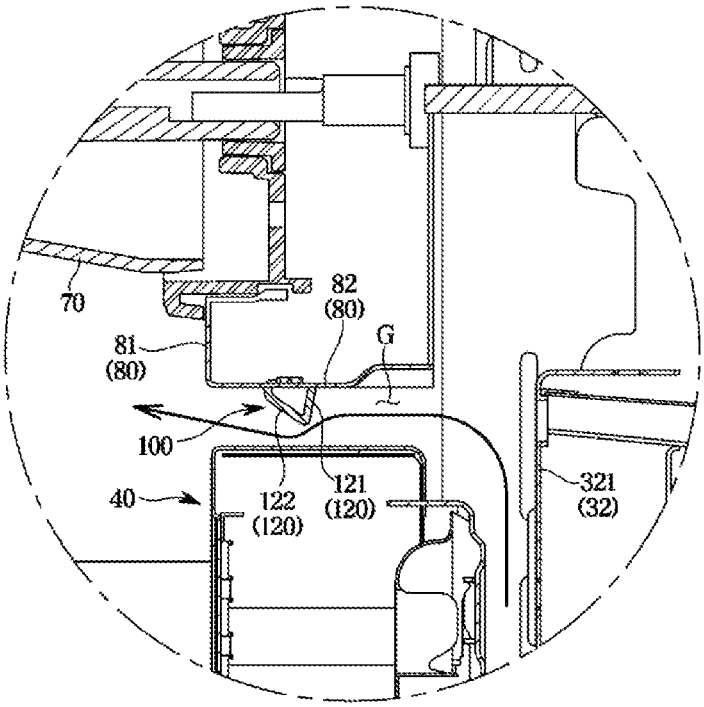
FIG. 13 is an enlarged cross-sectional view illustrating that a heated air is guided by the heat dissipation guide of the cooking apparatus according to an embodiment of the present disclosure.

FIG. 13 is an enlarged cross-sectional view illustrating that a heated air is guided by the heat dissipation guide of the cooking apparatus according to an embodiment of the present disclosure.

Referring to FIG. 13, the heat dissipation guide 100 may be mounted below the knob 70. In detail, the heat dissipation guide 100 may be mounted on the lower body 82 of the control panel 80.

The door 40 of the cooking apparatus 1 may be provided to open and close the cooking chamber. The cooking apparatus 1 may include the front plate 321 having the opening communicating with the cooking chamber. The front plate 321 may be disposed to face the door 40.

However, because a gap between the door 40 and the front plate 321 is not completely sealed, air heated inside the cooking chamber may flow between the door 40 and the front plate 321. In addition, the flowed heated air may flow toward the front of the cooking apparatus 1 through a gap G formed between the control panel 80 and the door 40 to form an updraft toward the knob 70.

The cooking apparatus 1 may also include a cooling flow path inside the main body 30 to cool the outside of the insulator disposed between the outer housing 31 and the inner housing.

Therefore, the cooling air flowing outside the inner housing may also flow between the control panel 80 and the door 40. Because the cooling air flows forward of the main body 30 after undergoing heat exchange, the air flowing between the control panel 80 and the door 40 may be warm air.

Therefore, the heat dissipation guide 100 of the cooking apparatus 1 according to an embodiment of the present disclosure is mounted below the control panel 80, so that the heated air discharged to the front of the main body 30 may not be directly transferred to the knob 70.

More specifically, the heat dissipation guide 100 may include a guide surface 121 and a connection surface 122.

The guide surface 121 of the heat dissipation guide 100 may be provided to face the main body 30. The guide surface 121 may be provided to guide a flow direction of the heated air flowing forward from the main body 30 downward.

The connection surface 122 may be formed in front of the guide surface 121 to connect the guide surface 121 and the coupling body 110 of the heat dissipation guide 100. Through this, the air heated inside the cooking chamber may naturally flow forward.

Therefore, as the heated air between the door 40 and the main body 30 is momentarily blocked downward by the guide surface 121 of the heat dissipation guide 100, the flow direction of the heated air may be more easily guided.

Through this, the knob 70 is not heated above a certain temperature, so that the user may not feel heat when holding the knob 70. In addition, an injury of the user may be prevented, so that a safety accident may be prevented in advance.

The foregoing has illustrated and described specific embodiments. However, it should be understood by those of skilled in the art that the present disclosure is not limited to the above-described embodiments, and various changes and modifications may be made without departing from the technical idea of the present disclosure described in the following claims.

Although the present disclosure has been described with various embodiments, various changes and modifications may be suggested to one skilled in the art. It is intended that the present disclosure encompass such changes and modifications as fall within the scope of the appended claims.

What is claimed is:

1. A cooking apparatus comprising:

a main body comprising a cooking chamber;

a door mounted on a front of the main body to open and close the cooking chamber;

a control panel disposed above the door and on which a knob is mounted; and a heat dissipation guide detachably mounted to a lower portion of the control panel, wherein the heat dissipation guide is provided to protrude from a lower surface of the control panel toward the door to block a heated air discharged through a gap between the control panel and the door from directing to the knob, wherein the control panel comprises a panel stopper provided to be elastically deformable, and the heat dissipation guide further comprises a heat dissipation stopper formed to protrude upward from an upper surface thereof so that one side of the heat dissipation stopper is in contact with the panel stopper, wherein the panel stopper is elastically deformable by the heat dissipation stopper.

2. The cooking apparatus according to claim 1, wherein the heat dissipation guide comprises:

a first hook provided on a first side thereof to be inserted into an inner side of the control panel; and a second hook provided on a second side thereof opposite to the first hook.

3. The cooking apparatus according to claim 2, wherein the control panel comprises:

a first cutout into which the first hook is inserted; and a second cutout into which the second hook is inserted.

4. The cooking apparatus according to claim 3, wherein the control panel comprises:

a front body forming a front surface on which the knob is mounted; and a lower body bent rearward from a lower portion of the front body and on which the first cutout and the second cutout are formed.

5. The cooking apparatus according to claim 4, wherein the control panel comprises the panel stopper extending from the lower body into a cutout hole of the second cutout.

6. The cooking apparatus according to claim 5, wherein the heat dissipation stopper comprises:

a pressing surface provided on an upper surface thereof and configured to press the panel stopper toward the inner side of the control panel while the heat dissipation guide is mounted on the control panel; and a support surface provided on a side surface thereof such that the heat dissipation guide comes into contact with the panel stopper and is supported in a state of being mounted on the control panel.

7. The cooking apparatus according to claim 5, wherein:

the second hook is provided in plurality, and the heat dissipation stopper is formed between the plurality of second hooks.

8. The cooking apparatus according to claim 5, wherein the heat dissipation guide is prevented from movement with respect to the control panel by the panel stopper of the control panel.

9. The cooking apparatus according to claim 5, wherein the first hook and the second hook extend from an upper surface of the heat dissipation guide toward the inner side of the control panel in a direction opposite to a side where the panel stopper is provided.

10. The cooking apparatus according to claim 1, wherein:

the control panel comprises a steel material, and the heat dissipation guide comprises a resin material.

11. The cooking apparatus according to claim 1, wherein the heat dissipation guide comprises:

a coupling body configured to couple to the control panel; and a blocking body extending downward from the coupling body.

12. The cooking apparatus according to claim 11, wherein the blocking body comprises:

a guide surface provided to face the main body, the guide surface to guide a flow direction of the heated air flowing forward from the main body downward; and a connection surface formed in front of the guide surface to connect the guide surface and the coupling body.

13. The cooking apparatus according to claim 1, wherein the heat dissipation guide is hooked to the control panel at a position corresponding to a lower portion of the knob.

14. A cooking apparatus including:

a main body including a cooking chamber;

a door provided to open and close the cooking chamber from a front of the main body;

a control panel disposed above the door and including a cutout hole;

a heat dissipation guide protruding downward of the control panel to be hooked when inserted into the cutout hole of the control panel;

a heat dissipation stopper extending upward from an upper surface of the heat dissipation guide to be inserted into the control panel; and a panel stopper provided to be elastically deformable extending from a lower surface of the control panel toward the cutout hole and provided in contact with the heat dissipation stopper to support one side of the heat dissipation stopper.

15. The cooking apparatus of claim 14, wherein the heat dissipation guide includes a guide surface provided to face the main body to guide a flow direction of a heated air discharged through a gap between the control panel and the door downward.

16. The cooking apparatus of claim 14, wherein:

the control panel includes a steel material, and the heat dissipation guide includes a resin material.

17. A cooking apparatus including:

a main body including a cooking chamber;

a door mounted on a front of the main body to open and close the cooking chamber;

a knob provided to be operable from outside the cooking apparatus, a control panel disposed above the door such that the knob is mount thereon and including a cutout portion on a lower surface thereof; and a heat dissipation guide including a hook extending from an upper surface thereof to be caught on the control panel by being inserted into an inner side of the control panel through the cutout portion, and a heat dissipation stopper protruding from the upper surface such that one side thereof is pressed by the control panel, wherein the control panel comprises a panel stopper provided to be elastically deformable and provided inside the cutout portion to extend toward the heat dissipation stopper so as to be in contact with the heat dissipation stopper, wherein the panel stopper is elastically deformable by the heat dissipation stopper.

* * * * *